US006435707B1

(12) United States Patent
Mori et al.

(10) Patent No.: US 6,435,707 B1
(45) **Date of Patent: *Aug. 20, 2002**

(54) CONTINUOUS MIXING APPARATUS WITH UPPER AND LOWER BLADED DISK IMPELLERS AND A NOTCHED BLADE

(75) Inventors: Hideyuki Mori, Fukui Prefecture; Toyohiko Yamadera; Mitsuo Hamada, both of Chiba Prefecture, all of (JP)

(73) Assignee: Dow Corning Toray Silicone Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/993,594

(22) Filed: Nov. 5, 2001

(30) Foreign Application Priority Data

Nov. 30, 2000 (JP) ..... 2000-364678

(51) Int. Cl.[7] ..... B01F 7/26; B01F 15/02

(52) U.S. Cl. ..... 366/171.1; 366/172.1; 366/172.2; 366/178.1; 366/294; 366/303; 366/312; 366/317

(58) Field of Search ..... 366/168.1, 171.1, 366/172.1, 172.2, 174.1, 178.1–178.3, 181.4, 293–296, 303, 304, 306, 307, 309, 312, 317; 241/46.017, 46.08

(56) References Cited

U.S. PATENT DOCUMENTS 3,308,171 A * 3/1967 Oikawa
3,929,320 A * 12/1975 Haller
3,998,433 A * 12/1976 Iwako
4,096,587 A * 6/1978 Haller
4,175,873 A * 11/1979 Iwako et al.
4,691,867 A 9/1987 Iwako et al.
5,599,102 A 2/1997 Hamada et al.
6,019,498 A * 2/2000 Hamada et al.
6,218,466 B1 * 4/2001 Hamada et al.

FOREIGN PATENT DOCUMENTS

JP 60-209233 * 10/1985
JP 60-209234 * 10/1985
JP 2000-449 6/1998

* cited by examiner

*Primary Examiner*—Charles E. Cooley
(74) *Attorney, Agent, or Firm*—Jim L. De Cesare

(57) ABSTRACT

Continuous mixing apparatus provide rapid production of a mixture of high uniformity, low viscosity, low density, high stability after mixing, without an increase in amounts of subsequently supplied liquids. Continuous production of liquid or liquid containing mixtures consists of (i) continuously loading the apparatus casing with materials of different types which are flowable such as different liquids or a powder and a liquid, (ii) mixing the components between independently rotating upper and lower bladed disk turbine impellers to form a coarse mixture, and (iii) mixing the coarse mixture with an additional portion of a liquid being continuously supplied to the casing. The apparatus includes upper and lower bladed disk turbine impellers disposed in a mixing chamber within a casing. The impellers are capable of being rotated independently at different rotational speeds. A plurality of blades are attached to the impellers. Upper and lower ring shaped baffles extend from the inner wall of the casing. A material loading opening is provided in the upper part of the casing and a liquid supply pipe extends through a side wall of the casing. A discharge opening in the bottom of the mixing chamber unloads the mixture.

4 Claims, 2 Drawing Sheets

CONTINUOUS MIXING APPARATUS WITH UPPER AND LOWER BLADED DISK IMPELLERS AND A NOTCHED BLADE

FIELD OF THE INVENTION

This invention is related to apparatus for continuously mixing materials of different types. More specifically, it relates to mixing apparatus for the continuous preparation of liquid or liquid containing mixtures by (i) continuously loading a casing with fluid materials of different types, e.g., different liquids or a powder and a liquid; (ii) continuously mixing the materials by means of an upper bladed disk turbine impeller and a lower bladed disk turbine impeller which rotate individually with respect to each other to prepare a coarse mixture; and (iii) continuously feeding a liquid into the casing for mixing with the coarse mixture.

BACKGROUND OF THE INVENTION

Japanese Patent Application Publication 2000-449 describes a process for preparing a water based grease like organopolysiloxane liquid by loading a mixing chamber with a liquid organopolysiloxane, an emulsification agent, and water, and mixing the components with a rotating disk equipped with scrapers. A disadvantage of this process consists in low stability and in coarsening of the grains contained in the emulsion. These problems occur because from the beginning of the process, the emulsification is conducted in a diluted state.

U.S. Pat. No. 4691867 (Sep. 8, 1987) describes a continuous mixer for the preparation of a slurry from a fine powder, oil coke, or similar pulverized bodies. The pulverized bodies and a liquid are fed into an upper mixing chamber and mixed in a humidified state by a rotating upper mixing disk. The resulting coarse mixture is sent to a lower mixing chamber where it is converted to a slurry by a rotating lower mixing disk. As coarse mixture flows to the lower mixing chamber with pulsation, the mixture contained in the lower mixing chamber tends to flow back to the upper mixing chamber. As a result, as the pulverized bodies and liquid are loaded into the upper mixing chamber, there is no means to use the mixtures other than in a diluted state. This is not acceptable in order to provide dispersions of the pulverized bodies.

U.S. Pat. No. 5599102 (Feb. 4, 1997) discloses a mixing apparatus for the continuous preparation of low viscosity mixtures by (i) loading a mixing chamber with a powdered material and a liquid, (ii) preparing a coarse mixture with a rotating disk, (iii) supplying another portion of the liquid to the rotating disk, and (iv) mixing it with the coarse mixture. A disadvantage of this mixing apparatus is in preparing emulsions. Thus, as the second portion of the liquid comes closer to the level of the rotating disk, the grain size of the particles become too large, and as a result, the mixture becomes unstable. When using this type of device to mix a powder with a liquid, the resulting mixture has too high a viscosity.

BRIEF SUMMARY OF THE INVENTION

Therefore, it is an object of the invention to provide a continuous mixing apparatus for mixing materials of different types which is capable of preparing mixtures of high stability, quickly, uniformly, without an increase in the level of the liquid, with low viscosity and low density of the mixture. These and other features of the invention will become apparent from a consideration of the detailed description.

DETAILED DESCRIPTION OF THE INVENTION

Figure 1:
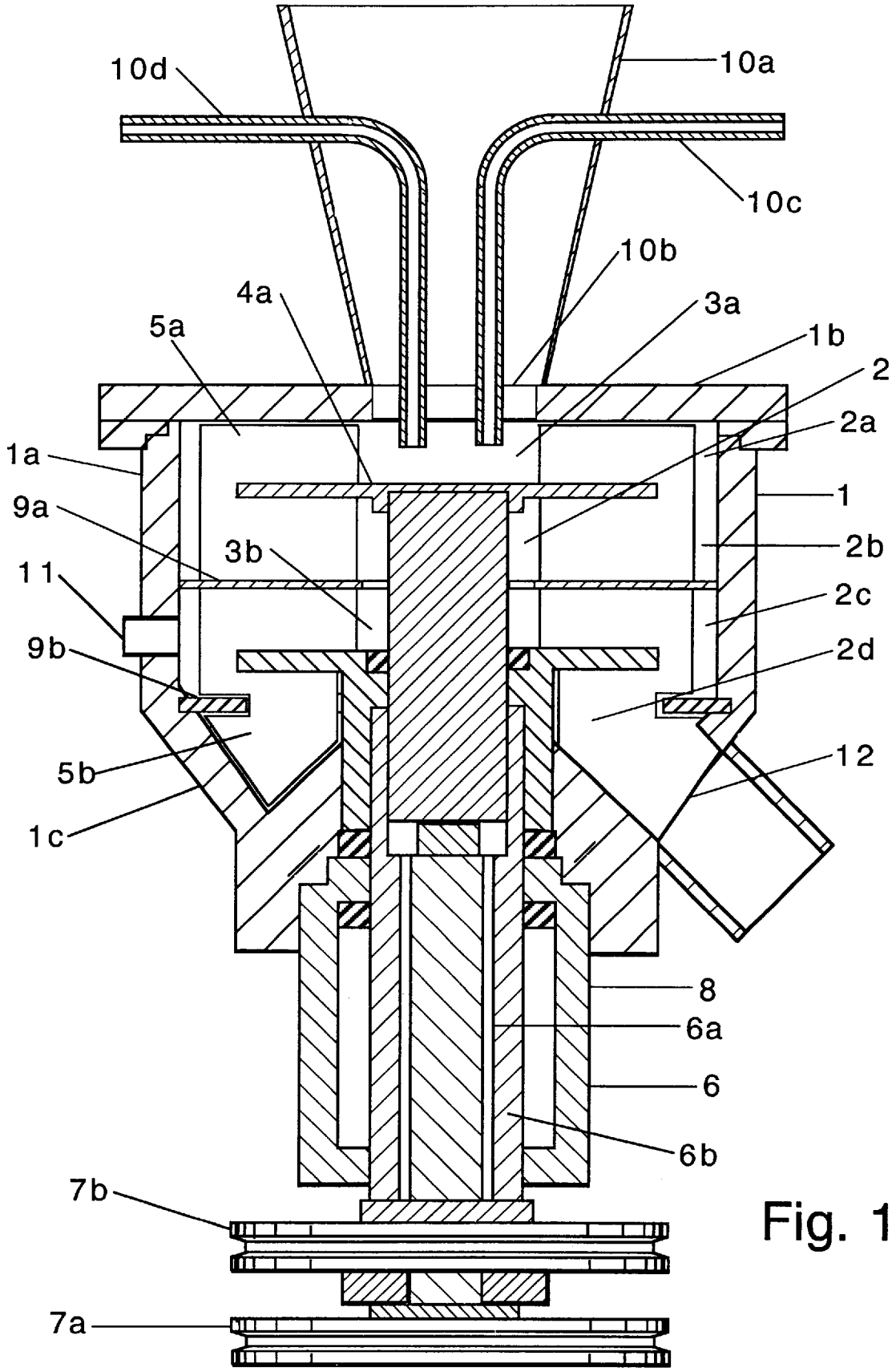
FIG. 1 is a vertical sectional view of a continuous mixing apparatus of the invention.

The continuous mixing apparatus according to this invention comprises:

(i) an upper bladed disk turbine impeller and a lower bladed disk turbine impeller installed in a mixing chamber of a casing, the impellers being capable of independent rotation;

(ii) an upper ring shaped baffle extending radially inwardly from the inner wall of the casing between the upper bladed disk turbine impeller and the lower bladed disk turbine impeller, the baffle being out of contact with the impellers;

(iii) a lower ring shaped baffle extending radially inwardly from the inner wall of the casing into a cutout portion of the lower bladed disk turbine impeller without contacting the lower bladed disk turbine impeller;

(iv) wherein the mixing chamber of the casing is divided by the upper bladed disk turbine impeller, the upper ring shaped baffle, and the lower bladed disk turbine impeller into an uppermost mixing chamber, an upper mixing chamber, an intermediate mixing chamber, and a lower mixing chamber;

(v) the upper part of the casing being provided with a material loading opening for loading materials of different types into the uppermost mixing chamber;

(vi) a liquid supply pipe passing through the side wall of the casing into the intermediate mixing chamber or into the lower mixing chamber for the supply of liquid into the chambers; and (vii) a discharge opening formed in the bottom of the mixing chamber for discharging the mixture outside the mixing apparatus from the lower mixing chamber.

In the continuous mixer, materials of different types such as a powder and a liquid, different powders, or different liquids are supplied to the uppermost mixing chamber, move in a radially outward direction over the surface of the disk of the rotating upper bladed disk turbine impeller, and are mixed using shear forces developed between the upper cover of the casing and the flat blades of a bladed disk turbine impeller, as well as shear forces developed between the inner walls of the cylindrical casing and the flat blades of bladed disk turbine impeller.

The mixture produced in this stage flows down into the upper mixing chamber through a gap between the periphery of the disk of the upper bladed disk turbine impeller and the inner wall of the cylindrical casing. In the upper mixing chamber, the mixture is subjected to uniform mixing under the action of shear forces developed between the inner wall of the cylindrical casing and the flat blades of the upper bladed disk turbine impeller, as well as by shearing forces developed between the upper ring shaped baffle and the flat blades of the upper bladed disk turbine impeller.

The mixture then flows down into an intermediate mixing chamber via a gap between the upper ring shaped baffle and the rotating shaft of the upper impeller. In the intermediate mixing chamber, the mixture moves over the surface of the disk of the lower bladed disk turbine impeller, and is further mixed under the effect of shearing forces developed between the inner walls of the cylindrical casing and the blades of the lower bladed disk turbine impeller, as well as by shearing forces developed between the upper ring shaped baffle and the blades of the lower bladed disk turbine impeller.

The mixture produced in this stage flows down into the lower mixing chamber through a gap between the periphery of the disk of the lower bladed disk turbine impeller and the inner wall of the cylindrical casing. An additional portion of the liquid is supplied to the intermediate or lower mixing chamber via a liquid supply tube that passes through the side wall of the casing and combined with the mixture. The mixture is again uniformly mixed under shearing forces developed between the blades of the lower bladed disk turbine impeller, the lower ring shaped baffle, and the inner wall of the cylindrical casing. The resulting uniform mixture with the additional portion of liquid is discharged from the mixer through a discharge opening formed in the bottom of the casing.

One example of a mixture with good flowability is a mixture of a powder with a liquid. The powder does not need be homogeneous and may be a mixture of different powders. Representative powders include starch, wheat, pigments, metal powders, powdered fillers, powdered polymers, or powdered rubbers. Some suitable powdered fillers are fumed silica, hydrophobically surface treated fumed silica, wet process silica, diatomaceous earth, quartz powder, powdered calcium carbonate, powdered magnesium oxide, alumina powder, powdered aluminum hydroxide, and carbon black. Powdered polymers include silicone resin powders and other thermoplastic resin powders.

The liquid can be homogeneous or in the form of a solution. Some suitable examples of liquids suitable for use in the invention are water, aqueous solutions, jellies, edible oils, mineral oils, liquid paraffins, organic solvents, solutions, liquid compounds, and liquid polymers. Some representative examples of liquid compounds are emulsions, surface active agents, thickeners, plasticizers, and stabilizers. Liquid polymers can be represented by liquid silicones, liquid polybutadienes, liquid polybutenes, liquid polyurethanes, and liquid epoxy resins.

As used herein, the term continuous mixing apparatus is intended to include continuous mixers suitable for mixing not only materials of different types, such as (i) powders and liquids, different powders, or different liquids, but also powders of the same species with different shapes and average grain dimensions, (ii) the same liquid but liquids with different viscosities such as gum type diorganopolysiloxanes and low viscosity diorganopolysiloxane, or the same liquid but of different densities. Auxiliary liquids can be included and can be the same or different as the liquid used in the coarse mixture.

Mixtures prepared and discharged from continuous mixing apparatus of the invention can be different depending on the type and mixing ratio of the mixture components. Such mixtures may be in the form of compounds, slurries, pastes, greases, emulsions, dispersions, or solutions.

The invention will be described in more detail with reference to the accompanying drawings. In FIG. 1, it can be seen that a mixing chamber 2 is formed in a casing 1 containing an upper bladed disk turbine impeller 3*a* and a lower bladed disk turbine impeller 3*b*. The impellers 3*a* and 3*b* each rotate from an individual rotary drive and they are installed so that their disk surfaces are arranged horizontally. The upper bladed disk turbine impeller 3*a* is rigidly fixed to the upper end of rotating shaft 6*a*. The axis of shaft 6*a* coincides with the center of disk 4*a*, and the lower bladed disk turbine impeller 3*b* is rigidly fixed to the upper end of rotating shaft 6*b*. The axis of shaft 6*b* coincides with the center of disk 4*b*.

Disk 4*a* is arranged perpendicular to the longitudinal axis of rotating shaft 6*a*, and disk 4*b* is arranged perpendicular to the longitudinal axis of rotating shaft 6*b*. Rotating shaft 6*a* is inserted into rotating shaft 6*b* and each shaft rotates independently of one another. At the lower end, rotating shaft 6*a* supports pulley 7*a* which is driven for rotation from a drive motor (not shown in the drawing). Similarly, at its lower end, rotating shaft 6*b* supports pulley 7*b* which is driven for rotation from a drive motor (not shown in the drawing). Shaft 6*b* is supported by bearing 8. The circumferential speed of disk 4*a* is preferably within the range from 3–240 m/sec, preferably 3–60 m/sec. The speed ratio of disk 4*a* to disk 4*b* is preferably within the range from 4:1 to 1:1 and cannot be 1:1. A circumferential speed of disk 4*a* exceeding the upper limit may cause a back flow of the mixture.

Figure 2:
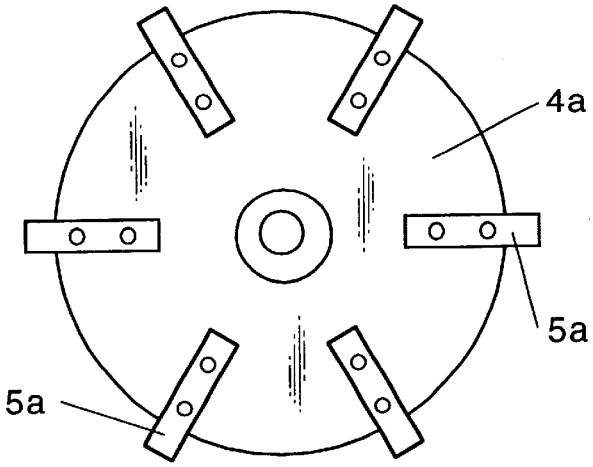
FIG. 2 is a top view of the upper bladed disk turbine impeller of the continuous mixing apparatus.
Figure 3:
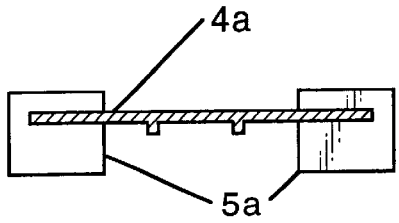
FIG. 3 is a sectional view of the upper bladed disk turbine impeller of the continuous mixing apparatus.

In FIGS. 2 and 3, six flat blades 5*a* are shown attached to disk 4*a* so that they extend radially outwardly and are perpendicular to the plane of disk 4*a*. The number of the blades is not limited to six, and any number of blades 5*a* can be used in numbers of two or more. The blades 5*a* should be spaced equally in the circumferential direction. It is not necessary to arrange the blades 5*a* to be perpendicular to the plane of disk 4*a*, and so they may be fixed in an inclined position as well. Although blades 5*a* are shown as being in the form of flat plates arranged radially and vertically, they may have a curved configuration.

Figure 4:
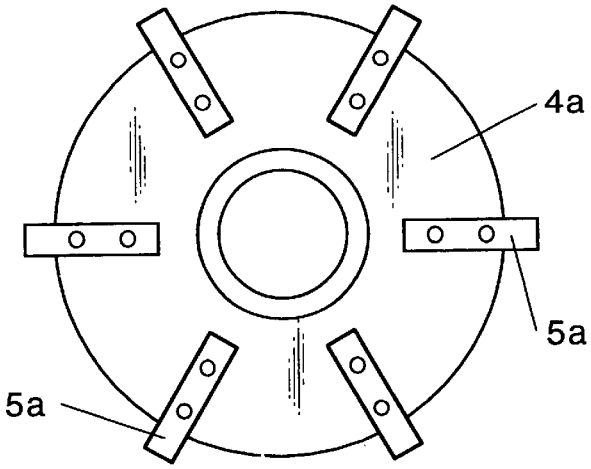
FIG. 4 is a top view of the lower bladed disk turbine impeller of the continuous mixing apparatus.
Figure 5:
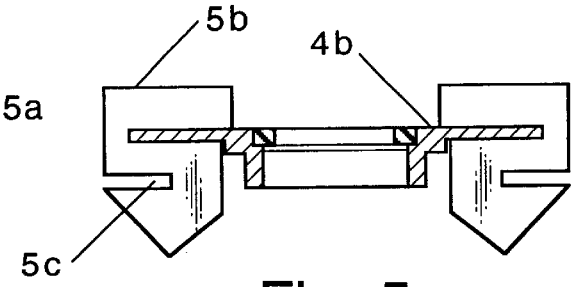
FIG. 5 is a sectional view of the lower bladed disk turbine impeller of the continuous mixing apparatus.

As can be seen in FIGS. 4 and 5, six flat blades 5*b* are attached to disk 4*b* so that they extend radially outwardly and perpendicular to the plane of disk 4*b*. The number of blades 5*b* not limited to six, and so any number of blades can be used in numbers of two or more. The blades 5*b* should be spaced equally in the circumferential direction. It is not necessary to arrange blades 5*b* perpendicular to the plane of disk 4*b*, and so they may be fixed in an inclined position as well. Blades 5*b* are flat plates arranged radially and vertically. A cutout 5*c* in each blade 5*b* extends horizontally inwardly from the periphery of the blades 5*b*. The cutouts 5*c* allows rotation of blades 5*b* with respect to a lower ring type partition 9*b*.

Upper ring shaped baffle 9*a* extends radially inwardly from the inner wall of cylindrical part 1*a* of casing 1 in the space between the upper bladed disk turbine impeller 3*a* and the lower bladed disk turbine impeller 3*b*, but out of contact with impellers 3*a* and 3*b*. A gap for the passage of the mixture remains between the periphery of the upper ring shaped baffle 9*a* and rotating shaft 6*a*. The lower ring type baffle 9*b* extends radially inwardly from the inner wall of casing 1 at the lower end of cylindrical portion 1*a*, and passes through the cutouts 5*c* in blades 5*b* without contacting the blades 5*b*. This arrangement allows for the rotation of lower bladed disk turbine impeller 3*b*. A gap for the passage of the mixture remains between the periphery of the lower ring shaped baffle 9*b* and rotating shaft 6*b*.

An uppermost mixing chamber 2*a* is formed in the mixing chamber of casing 1 between upper cover 1*b*, the upper bladed disk turbine impeller 3*a*, and the inner wall of cylindrical portion 1*a* of casing 1. An upper mixing chamber 2*b* is formed between the upper bladed disk turbine impeller 3*a*, the upper ring like baffle 9*a*, and the inner wall of cylindrical portion 1*a* of casing 1. Intermediate mixing chamber 2*c* is formed between the upper ring like baffle 9*a*, the lower bladed disk turbine impeller 3*b*, and the inner wall of cylindrical portion 1*a* of casing 1. Similarly, lower mixing chamber 2*d* is formed between the lower bladed disk turbine impeller 3*b*, the inner wall of downward tapered portion 1*c* of casing 1, and the inner wall of cylindrical portion 1*a* of casing 1.

A charge loading tube 10*a* for feeding materials to be mixed into uppermost mixing chamber 2*a* is attached to the central part of cover 1*b* on casing 1. Materials are loaded through loading port 10*b*. Two other material loading pipes 10*c* and 10*d* pass into charge loading tube 10*a* so that their ends are aligned with loading port 10*b*. Charge loading tube 10*a* is used primarily for loading powdered materials which normally constitute the largest part of the feed charge. If necessary, either one of loading pipes 10*c* and 10*d* can be eliminated or a double pipe can be used in their place. Liquid supply pipe 11 for supplying liquid to intermediate mixing chamber 2*c* passes through the side wall of cylindrical portion 1*a* of casing 1. If necessary, liquid supply tube 11 can be inserted into lower mixing chamber 2*d* into the space between disk 4*b* and lower ring like baffle 9*b*.

Alternatively, liquid supply tubes 11 can be introduced into both the intermediate mixing chamber 2*c* and lower mixing chamber 2*d*. Downward tapered portion 1*c* is connected to the lower end of cylindrical portion 1*a* of casing 1. To accommodate a part of the bearing in the central part of tapered portion 1*c*, portion 1*c* terminates in the form of a ring shaped hub with a V-shaped cavity. Discharge tube 12 for unloading a final mixture from the device is formed in the side wall of downward tapered portion 1*c* of casing 1.

When materials of different types are mixed using continuous mixing apparatus of the invention, a final mixture can be rapidly produced with high uniformity, low viscosity and density, high stability after the mixing, and without an increase in levels of subsequently supplied liquids. In mixing various liquids, as in the preparation of an emulsion of water and a silicone oil, an emulsion of high stability can be rapidly prepared with particles of very small dimension in the emulsion.

Other variations may be made in compounds, compositions, and methods described herein without departing from the essential features of the invention. The embodiments of the invention specifically illustrated herein are exemplary only and not intended as limitations on their scope except as defined in the appended claims.

what is claimed is:

1. Continuous mixing apparatus comprising:

an upper bladed disk turbine impeller and a lower bladed disk turbine impeller, the impellers being located in a mixing chamber of a casing, the impellers being mounted for independent rotation with respect to one another;

an upper ring shaped baffle extending radially inwardly from the inner wall of the casing between the upper bladed disk turbine impeller and the lower bladed disk turbine impeller, the baffle being arranged out of contact with the impellers;

a lower ring shaped baffle extending radially inwardly from the inner wall of the casing and into a cutout portion in the blades of the lower bladed disk turbine impeller so as to be in non-contacting relationship therewith;

the mixing chamber of the casing being divided by the upper bladed disk turbine impeller, the upper ring shaped baffle, and the lower bladed disk turbine impeller, into an uppermost mixing chamber, an upper mixing chamber, an intermediate mixing chamber, and a lower mixing chamber;

the upper part of the casing being provided with a material loading opening for loading materials of different types into the uppermost mixing chamber;

a liquid supply pipe passing through the side wall of the casing into the intermediate mixing chamber or into the lower mixing chamber for supplying liquids into the chambers;

and a discharge opening in the bottom of the mixing chamber for unloading the mixture from the mixing apparatus from the lower mixing chamber.

2. Apparatus according to claim 1 wherein the ratio of circumferential speed of upper bladed disk turbine impeller to circumferential speed of lower bladed disk turbine impeller is 4:1 to 1:1 excluding 1:1.

3. Apparatus according to claim 1 wherein the materials are liquids.

4. Apparatus according to claim 1 wherein the materials are liquids and powders.

* * * * *